US005235302A

United States Patent [19]

Seta

[11] Patent Number: 5,235,302

[45] Date of Patent: Aug. 10, 1993

[54] STARTER MOTOR ELECTROMAGNETIC SWITCH

[75] Inventor: Akio Seta, Hyogo, Japan

[73] Assignee: Mitsubishi Denki K.K., Tokyo, Japan

[21] Appl. No.: 923,388

[22] Filed: Aug. 3, 1992

[30] Foreign Application Priority Data

Aug. 30, 1991 [JP] Japan ..... 3-077779[U]

[51] Int. Cl.[5] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 3,409,851 | 11/1968 | Scheib et al. | 335/126 |
| 4,825,180 | 4/1989 | Miyaji . | |
| 4,990,874 | 2/1991 | Shiroyama | 335/131 |
| 5,015,980 | 5/1991 | Sugiyama | 335/126 |

FOREIGN PATENT DOCUMENTS

| | | | |
|---|---|---|---|
| 1056235 | 12/1957 | Fed. Rep. of Germany | 335/126 |
| 1405598 | 11/1972 | United Kingdom | 335/126 |

*Primary Examiner*—Lincoln Donovan

*Attorney, Agent, or Firm*—Sughrue, Mion, Zinn, Macpeak & Seas

[57] ABSTRACT

A starter motor electromagnetic switch which includes a single kind of electromagnetic switch that is capable of performing its necessary function even when two kinds of terminals are used in external connecting wires, thereby improving productivity and, when one of the two kinds of terminal in the connecting wires is a tightening type terminal, is also capable of surely preventing the terminal from turning. An L-shaped switch terminal is provided in such a manner that the bottom side portion thereof is fixed to an insulating cap and is connected by soldering to a lead conductor of an exciting coil. A screw terminal is received in the insulating cap such that it is prevented from turning. The threaded portion of the screw terminal is extended through and drawn out from the bottom side portion of the L-shaped switch terminal and is then fixed by a nut. In this manner, there is provided a single kind of electromagnetic switch which includes a switch terminal device consisting of two kinds of switch terminals.

5 Claims, 1 Drawing Sheet

STARTER MOTOR ELECTROMAGNETIC SWITCH

BACKGROUND OF THE INVENTION

The present invention relates to a starter motor electromagnetic switch and, in particular, to a switch terminal device of an exciting coil.

FIGS. 2(A) and 2(B) are respectively a front view and a side view, sectional in part, of a conventional electromagnetic switch. In these figures, reference numeral 1 designates an exciting coil wound on bobbin 2, 3 stands for a fixed iron core, 4 points out a case which forms a yoke and to which the fixed iron core 3 is fixed, and 5 represents a plunger supported on the inner periphery of the leading end portion of the case 4 in such a manner that it can be moved in the axial direction thereof. The plunger 5 is formed of a magnetic material and forms a movable iron core. 6 designates a hook the rear half section of which is inserted in the plunger 5 and also which is supported in such a manner that it can be moved in the axial direction thereof within a certain range. The hook 6 is engaged at the front end portion thereof with the upper end portion of a shift lever (not shown) and thus is able to rotate the shift lever.

Next, 7 stands for an insulating cap which is applied through a packing to the rear end of the fixed iron core 3 and connected by staking to the case 4. The insulating cap 7 is formed of a synthetic resin. 8 points out a pair of terminal bolts which are respectively extended integrally from a pair of fixed contacts (not shown) fixed within the cap 7. To one of the terminal bolts 8 is connected a terminal in a connecting line from a battery of a power supply, and to the other is connected a terminal in a connecting line to an electric motor. 9 designates a switch terminal which is formed in an L shape and is fixed to the insulating cap 7 by an eyelet 10. The exciting coil 1 has a lead conductor la which is connected to the switch terminal 9 by means of a soldering material 11. *7a* is a turn-preventive projection formed in the cap 7.

A bayonet terminal of a connecting wire from a key switch of an automobile is inserted into and connected to the switch terminal 9.

Now, FIGS. 3(A) and (B) are respectively a front view and a side view, sectional in part, of another type of electromagnetic switch according to the prior art, which are different from FIGS. 2(A) and (B) only in the structure of the switch terminal thereof. In these figures, reference numeral 12 designates a switch terminal which is constructed as follows 13 stands for a support member which is formed of a conductive material and has a substantially Z shape. One side portion of the support member 13 is fixed to the insulating cap 7 by the eyelet 10 and is connected to the lead conductor *1a* of the exciting coil 1 by means of the soldering material 11. 14 points out a screw terminal which includes a seat portion *14a* in the central portion thereof, a threaded portion *14b* in one end thereof, and a rod-shaped portion *14c* in the other end thereof. The rod-shaped portion *14c* of the screw terminal 14 is inserted into a hole formed in the other side portion of the support member 13 and, is connected to the hole by welding.

A terminal (for example, a pressure attached terminal) of a connecting wire from the key switch is fitted into the screw terminal 14 of the switch terminal 12 and is tightened with a nut (not shown).

In the above-mentioned conventional starter motor electromagnetic switch, in order to correspond to the kinds of terminals of connecting wires from the key switch, there are required two kinds of electromagnetic switches, that is, an electromagnetic switch including a switch terminal 9 and an electromagnetic switch including a switch terminal 12.

Also, in the switch terminal 12 having a screw terminal 14, there is not provided any means which can prevent the rotational movement of a terminal of its opponent connecting wire and, therefore, it is difficult to position the terminal in the draw-out direction thereof. Further, the turn preventive means of the support member 13 itself, to which the screw terminal 14 is fixed, is the turn-preventive projection *7a* provided in the insulating cap 7 and the support member 13 is fixed only by the eyelet 10 and soldering member 11. Thus, if a great torque is applied to the screw terminal 14, then a great moment is given to the support member 13 to thereby cause the support member to turn, with the result that the turn-preventive means may be broken or damaged.

SUMMARY OF THE INVENTION

According to the invention, there is provided an improved starter motor electromagnetic switch in which an L-shaped switch terminal is fixed to an insulating cap and is connected to a lead conductor of an exciting coil by means of a soldering member, and a bayonet terminal of a connecting wire from a key switch can be plugged into and connected to the L-shaped switch terminal. Further, a screw terminal, the head portion of which is received within an insulating cap in a turn-preventive manner and the threaded portion of which is extended through and drawn out from the middle of the bottom portion of the L-shaped switch terminal, is tightened and fixed by a nut. The terminal of the connecting wire from the key switch can be tightened to the threaded portion of the screw terminal by a nut.

According to the invention, when a terminal of an external connecting wire is a bayonet type terminal, then the terminal is plugged into and connected to the L-shaped switch terminal. Also, when the terminal is a screw tightening type terminal, then the terminal is plugged into and connected to the threaded portion of the screw terminal and is then tightened there by use of a nut. In this manner, according to the invention, a single kind of electromagnetic switch, which includes a common switch terminal device having two kinds of switch terminals, can cope with a case where the kinds of the terminals of the external connecting wire are variable.

DESCRIPTION OF THE PREFERRED EMBODIMENT

Figure 1A:
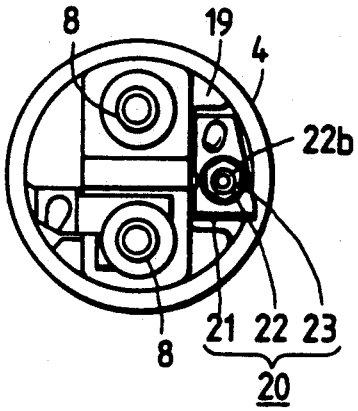
FIG. 1(A) is a front view of an embodiment motor electromagnetic switch according to the invention.
Figure 1B:
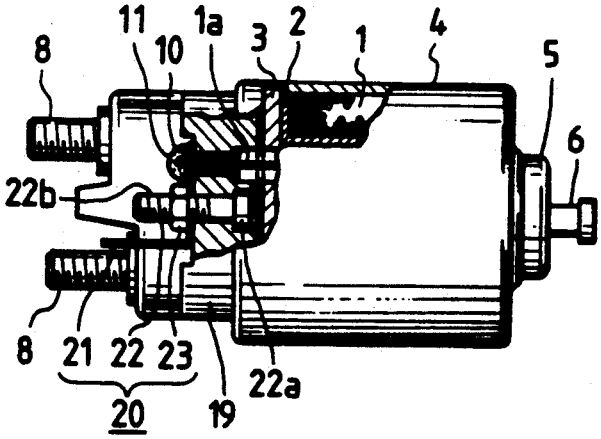
FIG. 1(B) is a side view of the above embodiment, with a switch terminal device part thereof shown in section.
Figure 2A:
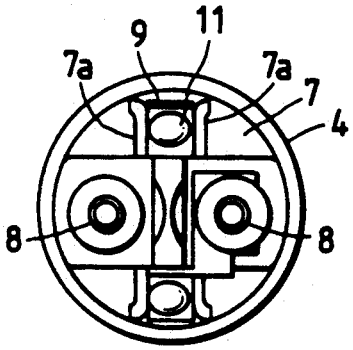
PRIOR ART FIG. 2(A)
FIG. 2(A) is a front view of a first embodiment of a conventional starter motor electromagnetic switch.
Figure 2B:
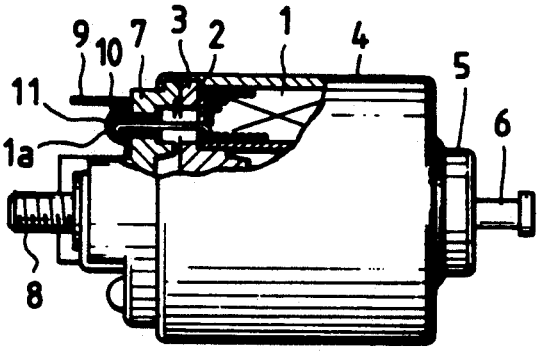
PRIOR ART FIG. 2(B)
FIG. 2(B) is a side view of the first embodiment of the conventional switch, with a switch terminal part thereof shown in section.
Figure 3A:
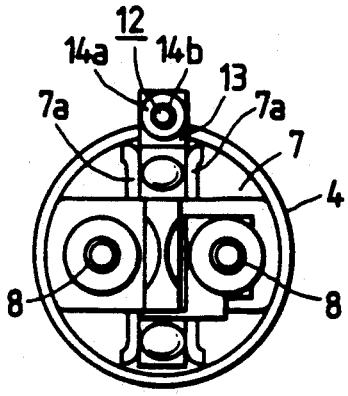
PRIOR ART FIG. 3(A)
FIG. 3(A) is a front view of a second embodiment of a conventional starter motor electromagnetic switch; and, FIG. 3(B) is a side view of the second embodiment, with a switch terminal part thereof shown in section.
Figure 3B:
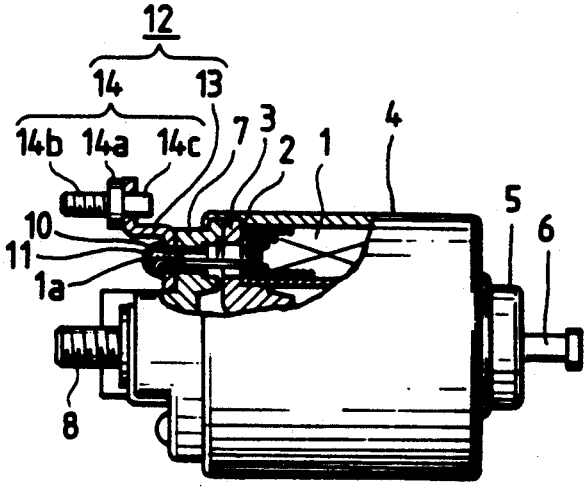
FIG. 3(B) PRIOR ART

Now, FIGS. 1(A) and (B) are respectively a front view and a partially sectional side view of an embodiment of a starter motor electromagnetic switch according to the invention, in which reference characters 1 to 6, 8, 10, 11, and 1*a* are the same as in FIG. 2. In FIG. 1, 19 stands for an insulating cap which is formed of a synthetic resin product, is abutted against the end of the fixed iron core 3 through a packing and is staked to the case 4. 20 points out a switch terminal device provided in the insulating cap 19, the structure of which device is as follows. 21 designates an L-shaped terminal, the end portion of the bottom portion of which is staked and fixed by the eyelet 10, is connected to the lead conductor 1*a* of the exciting coil 1 by means of the soldering member 11. Also, 22 stands for a screw terminal which includes a quadrangular head portion 22*a* and a threaded portion 22*b*. The head portion 22*a* of the screw terminal 22 is received within the insulating cap 19 in such a manner that it is prevented from turning. The threaded portion 22*b* of the screw terminal 22 is extended through and drawn out from the insulating cap 19 and the middle portion of the bottom side portion of the switch terminal 21, is tightened by a nut 23 and is fixed to the insulating cap 19.

When a terminal of a connecting wire from the key switch is a bayonet type terminal, then the terminal is plugged into and connected to the switch terminal 21. Also, when it is a tightening type terminal, then the terminal is inserted into the screw terminal 22 and is then tightened and connected by a nut (not shown). In this case, the tightening type terminal is prevented from turning by a vertical side portion of the switch terminal 21. Although in the illustrated embodiment the screw terminal 22 is arranged such that it has a quadrangular head portion and it is prevented from turning by the insulating cap 19, the turn-preventive means is not limited to this, but other means can also be used.

As has been described heretofore, according to the present invention, an L-shaped switch terminal is fixed to an insulating cap, a lead conductor of an exciting coil is connected to the end portion of a bottom side portion, a screw terminal is received within the insulating cap in a turn-preventive way, a threaded portion of the screw terminal is extended through and drawn out from the bottom side portion of the switch terminal and is then tightened and fixed by a nut, and the switch terminal and screw terminal are allowed to form a switch terminal device. Due to this, a single kind of electromagnetic switch is capable of dealing with a case where the kinds of terminals of externally connecting wires vary. Also, when the terminal of the connecting wire is a tightening type terminal, then the terminal is prevented from turning by a vertical side portion of the switch terminal to thereby facilitate the positioning of the terminal in the draw-out direction thereof. Further, in the case of the tightening type terminal, the terminal is tightened to the screw terminal and, therefore, the strength of the turn prevention of the terminal is increased to thereby improve the reliability thereof.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. An electromagnetic switch for a starter motor, comprising:

a bobbin;

an exciting coil wound on said bobbin, said exciting coil having a lead conductor;

a fixed iron core for supporting said bobbin;

a case forming a yoke and securing said fixed core;

an insulating cap connected to said case;

a L-shaped switch terminal for receiving a bayonet terminal of a connecting wire from a key switch, said L-shaped switch terminal being fixed to said insulating cap;

means for connecting said L-shaped switch terminal to said lead conductor of said exciting coil;

a screw terminal having a head portion received within said insulating cap in a turn-preventive manner and a threaded portion extending through and drawn out from the middle of a first portion of said L-shaped switch terminal; and means for securing said threaded portion of said screw terminal to said insulating cap.

2. An electromagnetic switch according to claim 1, wherein said securing means comprises a nut.

3. An electromagnetic switch according to claim 1, wherein said insulating cap comprises synthetic resin, said insulating cap abutting an end of said fixed iron core through a packing and being secured to said case.

4. An electromagnetic switch according to claim 1, further comprising an eyelet, said eyelet securing the end portion of said first portion of said L-shaped switch terminal.

5. An electromagnetic switch according to claim 1, wherein said head portion of said screw terminal has a quadrangular shape.

* * * * *